US009870696B2

(12) United States Patent
Aich et al.

(10) Patent No.: US 9,870,696 B2
(45) Date of Patent: Jan. 16, 2018

(54) SMART DEVICE VEHICLE INTEGRATION

(71) Applicant: FORD GLOBAL TECHNOLOGIES, LLC, Dearborn, MI (US)

(72) Inventors: Sudipto Aich, Palo Alto, CA (US); Casey Bryan Feldman, Sunnyvale, CA (US); Jamel Seagraves, Mountain View, CA (US); Yonathan Aklilu Redda, Sunnyvale, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 19 days.

(21) Appl. No.: 14/589,458

(22) Filed: Jan. 5, 2015

(65) Prior Publication Data

US 2016/0196731 A1 Jul. 7, 2016

(51) Int. Cl.
*G08B 1/08* (2006.01)
*G08B 25/08* (2006.01)

(52) U.S. Cl.
CPC ..... *G08B 25/08* (2013.01)

(58) Field of Classification Search
CPC ..... G08B 17/10; G08B 27/001; G08B 25/10
USPC ..... 340/539.17
See application file for complete search history.

(56) References Cited

U.S. PATENT DOCUMENTS 9,019,111 B1 * 4/2015 Sloo ..... G01N 27/02 340/628
2007/0298758 A1 12/2007 Verma et al.
2008/0126929 A1 5/2008 Bykov
2011/0215901 A1 * 9/2011 Van Wiemeersch .... B60R 25/04 340/5.54
2011/0276219 A1 * 11/2011 Swaminathan ..... G07C 5/0858 701/29.6
2012/0041633 A1 * 2/2012 Schunder ..... B60K 35/00 701/29.2
2013/0231784 A1 * 9/2013 Rovik ..... G05B 15/02 700/276
2013/0311032 A1 * 11/2013 Shelcusky ..... G07C 5/008 701/29.1
2014/0129053 A1 * 5/2014 Kleve ..... B60R 25/24 701/2
2014/0129113 A1 * 5/2014 Van Wiemeersch .... F02D 28/00 701/102

(Continued)

FOREIGN PATENT DOCUMENTS

WO WO200025478 A2 * 5/2000

OTHER PUBLICATIONS

Samsung Electronics, Samsung Smart Home Aims to Integrate All Your Smart Devices on One Platform, Techhive article, Jan. 5, 2014, 3 pages. <http://www.techhive.com/article/2083990/samsung-smart-home-aims-to-integrate-all-your-smart-devices-on-one-platform>.

*Primary Examiner* — Juan A Torres
(74) *Attorney, Agent, or Firm* — Frank MacKenzie; Brooks Kushman P.C.

(57) ABSTRACT

A vehicle computing system includes at least one processor configured to communicate with a remote smoke detector device includes a smart device interface configured to provide access to the remote smoke detector device, a scripting application configured to utilize the smart device interface to execute scripting settings to manage the remote smoke detector, and a user interface of the scripting application configured to output one or more messages from the remote smoke detector.

15 Claims, 7 Drawing Sheets

(56) References Cited

U.S. PATENT DOCUMENTS

| | | | | |
|---|---|---|---|---|
| 2014/0129301 | A1* | 5/2014 | Van Wiemeersch | G07F 17/0057 705/13 |
| 2015/0097663 | A1* | 4/2015 | Sloo | G01N 27/02 340/501 |
| 2015/0097665 | A1* | 4/2015 | Sloo | G01N 27/02 340/514 |
| 2015/0097682 | A1* | 4/2015 | Rossi | G01N 27/02 340/628 |
| 2015/0097684 | A1* | 4/2015 | Sloo | G01N 27/02 340/628 |
| 2015/0097687 | A1* | 4/2015 | Sloo | G01N 27/02 340/632 |
| 2015/0097688 | A1* | 4/2015 | Bruck | G01N 27/02 340/632 |
| 2015/0100166 | A1* | 4/2015 | Baynes | F24F 11/0009 700/278 |
| 2015/0109112 | A1* | 4/2015 | Fadell | G08B 27/003 340/328 |
| 2015/0114574 | A1* | 4/2015 | Fiedler | E05F 15/71 160/7 |
| 2015/0193127 | A1* | 7/2015 | Chai | G06F 3/04842 715/719 |
| 2015/0254970 | A1* | 9/2015 | Sloo | G01N 27/02 340/506 |
| 2015/0358387 | A1* | 12/2015 | Smereka | H04L 67/025 715/740 |
| 2015/0370621 | A1* | 12/2015 | Karp | G05D 23/1951 719/328 |
| 2015/0372832 | A1* | 12/2015 | Kortz | G05D 23/1951 700/278 |

* cited by examiner

SMART DEVICE VEHICLE INTEGRATION

TECHNICAL FIELD

This disclosure generally relates to vehicle integration with smart devices.

BACKGROUND

Smart devices include various types of network-connected devices that perform useful functions and expose device functionality over a network connection. As some examples, smart devices may include networked thermostat controls, smoke and carbon monoxide detectors, remote door locks and openers, remote light controls, security devices such as window sensors, flood sensors, and webcams, and even media systems such as remote controls for music playback.

SUMMARY

In at least one embodiment, a vehicle computing system includes at least one processor configured to communicate with a remote smoke detector device. The at least one processor includes a smart device interface configured to provide a vehicle computing system with access to the remote smoke detector device, a scripting application configured to utilize the smart device interface to execute scripting settings to manage the remote smoke detector device, and a user interface of the scripting application configured to output one or more messages from the remote smoke detector device.

In at least one embodiment, a system for communicating with the smart smoke detector device includes a user interface display and at least one vehicle processor. The at least one vehicle processor may be in communication with the remote smoke detector device. The at least one vehicle processor may be configured to monitor the remote smoke detector device for an alert message. The at least one vehicle processor may output a warning message and an emergency contact number at the user interface display based on receiving the alert message.

In at least one embodiment, a remote smoke detection method includes a vehicle computing system establishing a connection to a remote smoke detector device. The method may monitor the remote smoke detector device via a display at the VCS. The method may receive an emergency notification that smoke has been detected from the remote smoke detector device. The method may output one or more remedial actions at the display based on the emergency notification.

DETAILED DESCRIPTION

Figure 1:
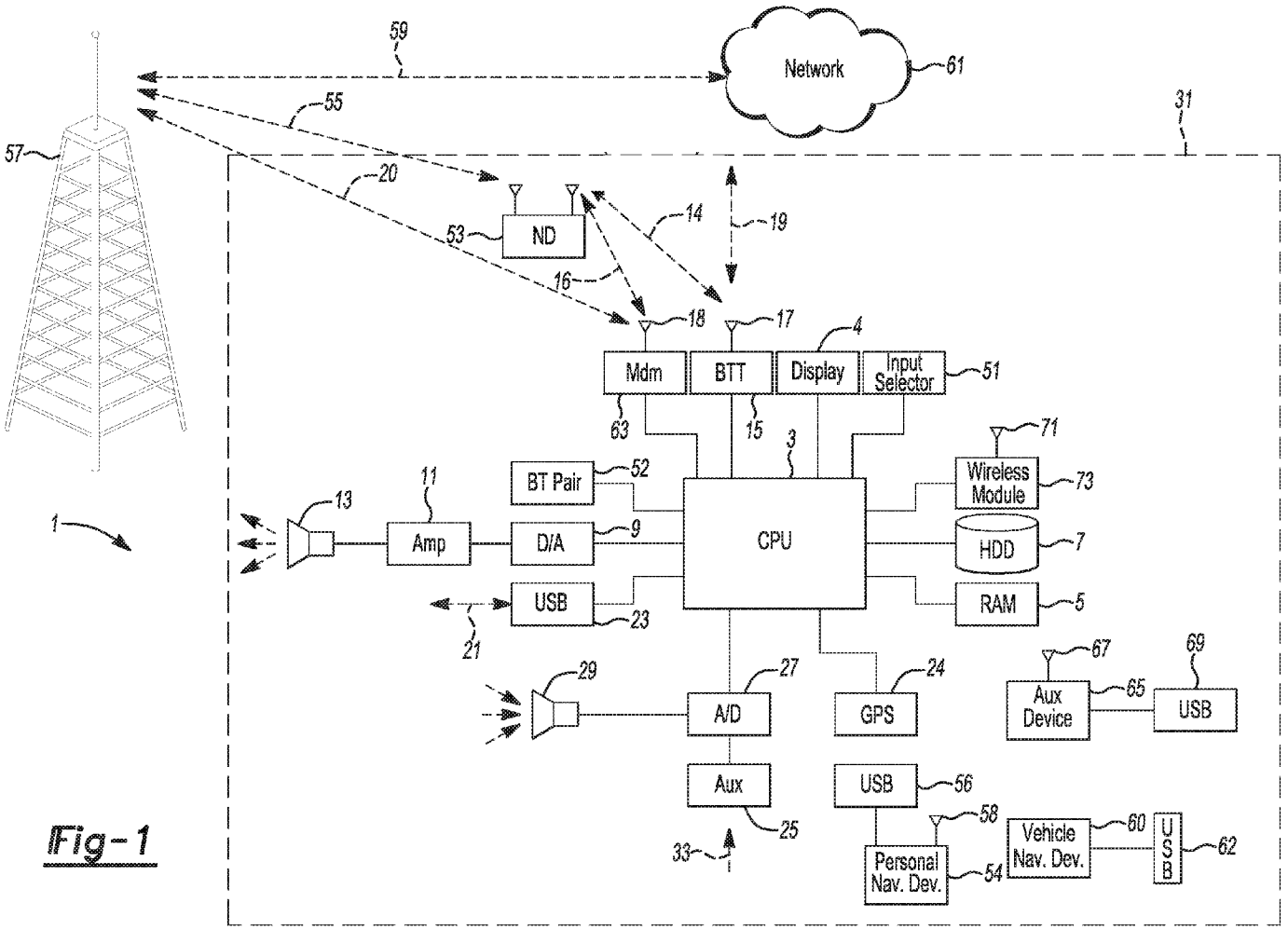
FIG. 1 is an exemplary block topology of a vehicle infotainment system implementing a user-interactive vehicle based computing system.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electric devices may be configured to execute a computer-program that is embodied in a non-transitory computer readable medium that is programmed to perform any number of the functions as disclosed.

Many integrations with smart devices include a single application communicating with a single smart device or family of devices, where the single application is configured to allow the user to control the smart device or family of devices via a user interface of the application. While such an approach works with select smart devices, it may be difficult to scale as the number and type of smart devices grows. In the vehicle environment in particular, control of smart devices may lead to distracted driving.

An improved vehicle system may be configured to include features for controlling smart devices without distracting the driver. The system may include a smart device interface configured to communicate with and control the smart devices of the system. The functionality exposed by the smart device interface may then be made available to the other applications of the vehicle system through an application programming interface (API), such that other applications of the vehicle may be able to interact with smart device features. In an example, the API may be registered with a vehicle service configured to define locations and access to the smart devices of the system as well as associated supported functions. If an application of the vehicle would like to control the smart device, the desiring application may request to do so using the exposed smart device interface API. The smart device interface may accordingly act as a broker to translate and perform the request of the calling application, including informing the requester of errors, alarms, or responses from the controller smart device.

Once a smart device is configured for use by the vehicle system, the system may be further configured to utilize a device scripting application to define scripting settings. The settings may include scripting triggers having conditions based on vehicle data and/or information received from the smart device. The scripting triggers may have scripting actions to be requested by the device scripting application, when the condition is satisfied, communicate with the smart devices via the smart device interface. For example, the device scripting application of the system may utilize vehicle data such as driver workload or other information obtained from a connected mobile device as a trigger to communicate with the connected smart device to automatically output information to a vehicle occupant.

As a more specific example, a vehicle may maintain smart device credentials allowing the smart device interface to be able to connect to a smart home smoke and carbon monoxide detector (herein known as a smart smoke detector) at the user's home. When the device scripting application of the vehicle receives information from the smart smoke detector, such as a low battery, power loss, or that smoke or carbon monoxide is detected, the vehicle system may utilize the information to trigger one or more remedial actions. The system may further include a user interface facilitating the addition of this and other scenarios, without requiring the user to install different application for each automation purpose.

Thus, the vehicle applications and device scripting application may have access to communicate with the smart device(s), resulting in direct communication of an emergency notification to the vehicle occupant, and more overall functionality for the vehicle. Moreover the system may be able to manage when and how to control each smart device, as well as provide appropriate feedback to a calling application when a smart device has detected an emergency, is unavailable, or an error occurs. Thus, by way of the communication, the vehicle may be able to present information to the vehicle occupant, perform configuration of the smart device, and/or a combination thereof.

The vehicle system may include a vehicle infotainment system. The vehicle infotainment system may output information that may assist the driver to manage one or more applications. The vehicle infotainment system may process information for display using a vehicle computing system. The output information may be displayed at a user screen, at a speaker, an instrument cluster, and/or a combination thereof.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, spoken dialog system with automatic speech recognition and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, a smart device (not shown) in communication with the network 61, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication. The system 1 may communicate the data received from the nomadic device and/or the additional sources to one or more outputs. The one or more outputs may include, but is not limited to, the display 4, speaker 13, and/or a combination thereof.

Further, the CPU could be in communication with a variety of other auxiliary devices 65. These devices can be connected through a wireless 67 or wired 69 connections. Auxiliary device 65 may include, but are not limited to, personal media players, wireless health devices, portable computers, and the like.

Also, or alternatively, the CPU could be connected to a vehicle based wireless router 73, using for example a WiFi (IEEE 803.11) 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the exemplary processes.

Figure 2:
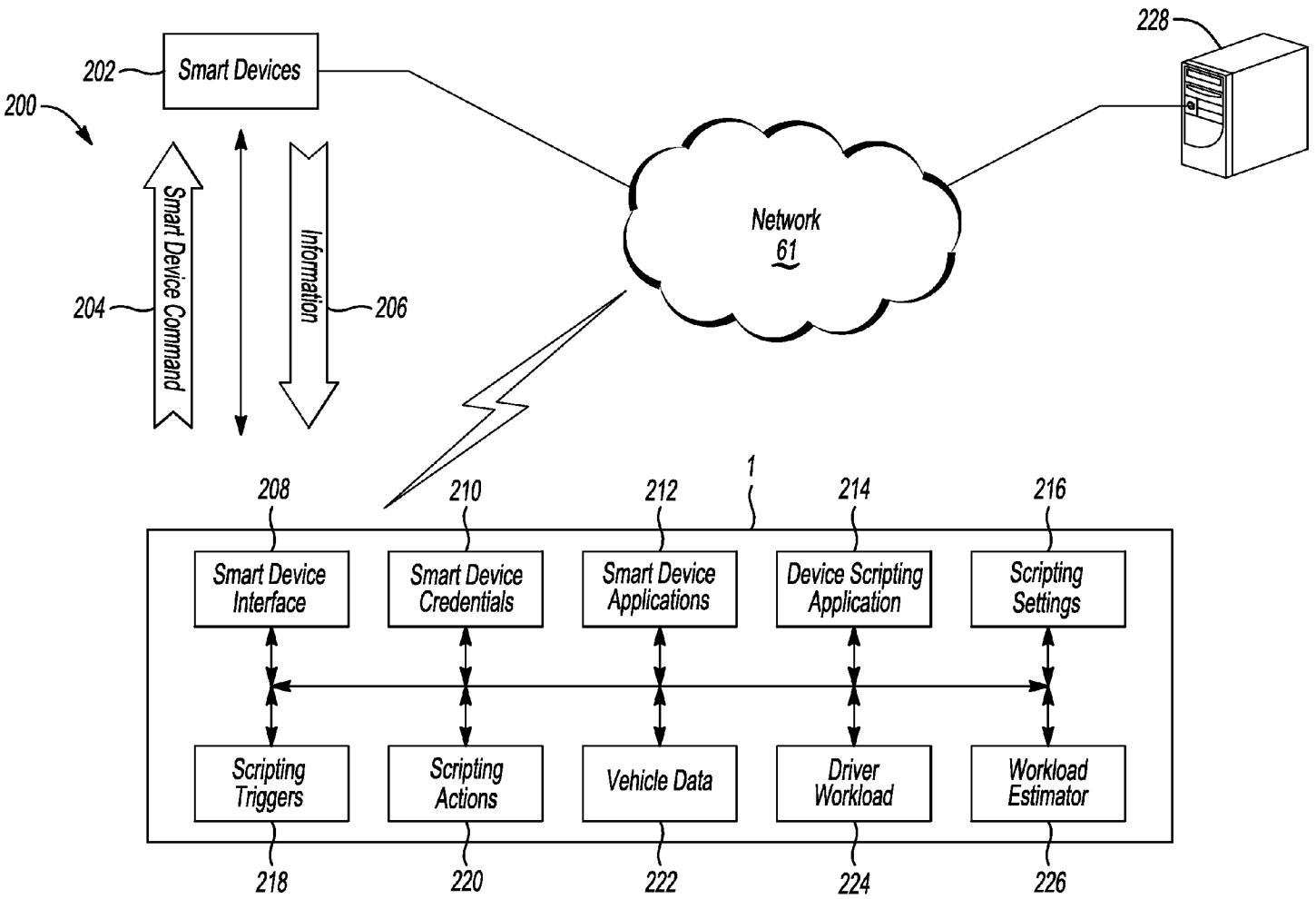
FIG. 2 illustrates an exemplary smart device integration system.
Figure 3:
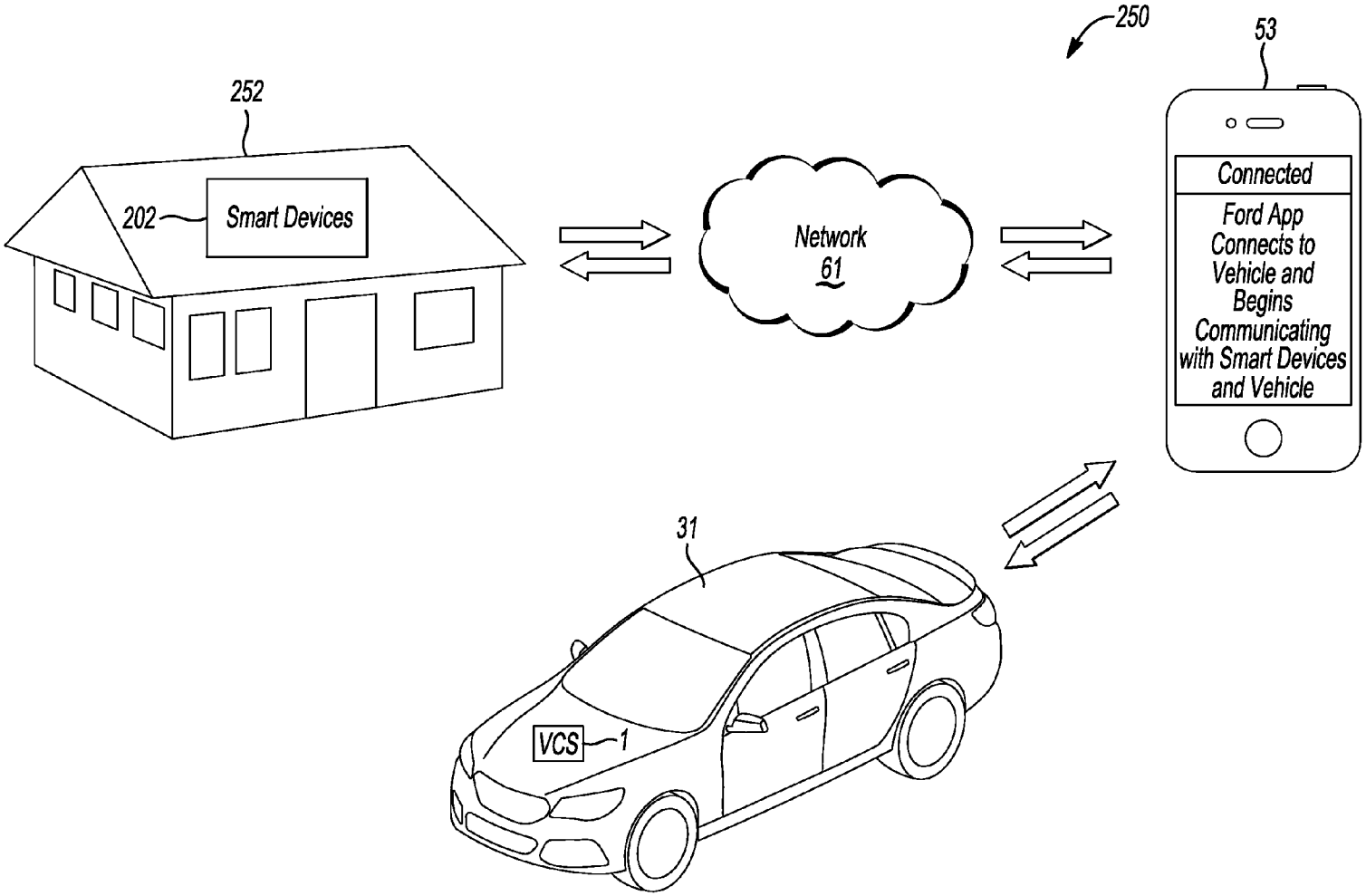
FIG. 3 illustrates an exemplary smart device integration system in communication with a smart device located in a home.

FIG. 2 illustrates an exemplary smart device integration system 200. As illustrated, the system 200 includes smart devices 202 connected to the network 61. The system 200 further includes a smart device interface 208 of the VCS 1 configured to access the smart device 202 according to security credentials 210, send smart devices commands 204 over the network 61 to the smart device 202, and receive information 206 over the network 61 from the smart device 202. The system 200 also includes smart devices applications 212 configured to utilize the smart device interface 208 to control and/or configure the smart devices 202 according to user input, and a device scripting application 214 configured to utilize the smart device interface 208 to communicate with the smart devices 202 according to scripting settings 216. Each scripting setting 216 may be associated with one or more scripting triggers 218 and one or more scripting actions 220. The system further includes a workload estimator 226 configured to receive vehicle data 222 and determine driver workload 224. The system 200 may also include a configuration server 228 configured to facilitate configuration of the scripting settings 216 remote from the vehicle 31. It should be noted that the illustrated system 200 is merely exemplary, and more, fewer, and/or differently located elements may be used. As one example, the system 200 may utilize a data connection of a nomadic device 53 to facilitate the communication between the VCS 1 and the smart devices 202 as illustrated in FIG. 3.

The smart devices 202 may include various types of network-connected devices that perform useful functions and expose device functionality over the network 61. Exemplary smart devices 202 may include, as some non-limiting examples, a networked smart smoke detector such as the Nest Protect system provided by Google, Inc. of Mountain View, Calif., and remote door locks such as the Schlage Z-Wave Deadbolt system provided by Allegion Plc of Carmel, Ind. As some further examples, smart devices 202 may include other types of devices such as remote light systems, security devices such as window sensors, flood sensors, webcams, and even media systems such as remote control devices for music playback.

The smart device commands 204 may include messages configured to control functions and/or settings of the smart devices 202. As illustrated, the smart devices 202 may be configured to receive the smart device commands 204 over the network 61. As some other examples, the smart devices 202 may be configured to receive the smart device commands 204 over other networks or types of network connection, such as over a BLUETOOTH connection, over a ZIGBEE wireless mesh network, or over another suitable type of network or network protocol for providing smart device commands 204. The smart device commands 204 may be configured to cause the smart devices 202 to perform actions, such as lock or unlock doors, enable detection of smoke and/or carbon monoxide, configure an emergency contact list, set thermostat settings, turn on and off lights, and enable or disable alarm functionality. The command responses 206 may include messages configured to inform senders of the smart device commands 204 whether the smart device commands 204 were successful. In some cases, the smart device commands 204 may be configured to request status information regarding the smart devices 202 (e.g., whether a light is on, whether smoke is detected, a carbon monoxide status, whether a door is closed or locked, a current temperature of a home), and the command responses 206 may be configured to return the requested status information back to the requester.

The smart device interface 208 may be configured to provide the VCS 1 with access to the features of the smart devices 202. To provide the access, the smart device interface 208 may be configured to expose an API allowing other applications of the VCS 1 to provide smart device commands 204 to the smart device 202 and receive command responses 206 from the smart device 202 responsive to the provided smart device commands 204. For example, in response to a smoke detection alert form the smart smoke detector, the VCS 1 may provide Emergency 911 communication using an Emergency 911 application.

The smart devices 202 may be configured to require security credentials 210 to allow a device to provide smart device commands 204 to the smart devices 202. As some examples, the smart devices 202 may require an account name or username, and a password, passphrase, personal identification number, fingerprint, or other credential that may be used by the smart devices 202 to ensure that the requesting device is authorized to access the smart device 202 features for the corresponding account or user. The VCS 1 may be configured to maintain and provide the security credentials 210 for the smart devices 202 to facilitate the connection and command execution using the smart device interface 208. In some cases, the smart device interface 208 may be further configured to maintain information regarding the possible smart devices 202 that may be controllable by the smart device interface 208. For example, the smart device interface 208 may expose API information related to the smart devices 202 for which security credentials 210 are available, as well as information regarding the capabilities of the connected smart devices 202 (e.g., based on the model of smart device 202, based on a query of the smart device 202 by the smart device interface 208 for capability information).

The smart device applications 212 may include one or more applications installed at the VCS 1 and configured to make use of functionality of the smart device 202 via the smart device interface 208. As an example, the smart device applications 212 may include a smart smoke detector device application 212 configured to allow a user to set emergency contact information, monitor carbon monoxide levels, monitor smoke detection levels, and receive other detection information of the smart smoke detector device 202. As another example, the smart device applications 212 may include a security smart device application 212 configured to allow the user to view current door lock status, and lock or unlock service-controlled doors and locks.

The device scripting application 214 may be another example of a smart device application 212, and may be configured to allow a user to script the functions of the smart devices 202. The device scripting application 214 may include functionality to determine when specified trigger conditions 218 have occurred, and to perform specified actions 220 in response to triggering of the trigger conditions 218. These triggers and actions may be referred to herein as scripting settings 216.

The vehicle data 222 may include various inputs that may be monitored by the VCS 1 to receive indications of the vehicle 31 status. Exemplary vehicle data 222 may include, for example, speed, yaw, pitch, roll, lateral acceleration, temperature, and rain sensor inputs, as some possibilities. In some cases, the vehicle data 222 may include elements of data made available via the vehicle bus (e.g., via the controller area network (CAN)). In other cases, the vehicle data 222 may include elements of data that may be otherwise received from vehicle 31 sensors and systems (e.g., yaw information received from a stability system, rain sense information received from a weather detection system, etc., location information received from a positioning system, etc.). In yet further cases, the vehicle data 222 may include other information obtained from a connected mobile device (e.g., from nomadic device 53 over Bluetooth, WiFi, etc.).

The trigger conditions 218 of the scripting settings 216 may be defined according to a relationship of one or more elements of vehicle data 222 to one or more predefined conditions. For example, in response to a request to configure the smart device, the information may be output by the system based on a trigger condition 218. The trigger condition may be configured to define a relationship of vehicle speed, such as to define a condition that is triggered when the vehicle 31 is below a predefined speed (e.g., driving less than zero miles per hour) and/or the powertrain gear selection, (e.g., the powertrain is in a PARK gear) before enabling configuration of the smart device.

The actions 220 of the scripting settings 216 may be defined according to an available feature of a connected smart device 202. As an example, an action 220 may include sending a smart device command 204 to a smart smoke detector device 202 to configure an emergency contact list, remedial actions, and/or a combination thereof. As another example, the action 220 may include sending a smart device command 204 to a security system to unlock a door, or sending a smart device command 204 to a lighting smart device 202 to turn lights on or off.

The device scripting application 214 may further include a user interface facilitating the configuration of the scripting settings 216, without requiring the user to install a dedicated smart device application 212 for each purpose. Further aspects of the user interface of the device scripting application 214 are discussed in detail below.

In some cases, the user interface of the device scripting application 214 may be made available to the user only when driver workload 224 permits the user to invoke the user interface. For example, the workload estimator 226 may be configured to receive the vehicle data 222 (e.g., via the CAN bus, from the vehicle systems or sensors, etc.) and identify a driver workload 224 based on the received vehicle data 222. In one possible approach, the workload estimator 226 may be configured to utilize a set of rules to determine a driving situation from the vehicle data 222, and to further determine the driver workload 224 according to the driving situation. More specifically, based on the received vehicle data 222, the workload estimator 226 may be configured to match the received vehicle data 222 against one or more conditions specified by the rules where each rule may be defined to indicate a particular driving situation indication encountered by the vehicle 31 when the conditions of the rule are satisfied. As some examples, rules may define a high traffic density condition according to criteria identifying many stops and starts in brake, accelerator or speed vehicle data 222, a merge condition according to vehicle data 222 indicative of a swerve maneuver at speed, and/or a parked condition according to a park vehicle gear selection indicated in the vehicle data 222, etc. Moreover, each driving situation may be associated with a corresponding driver workload 224 (e.g., parked vehicle situations associated with a low-level driver workload 224, merge situations associated with a mid-level driver workload 224, high traffic density associated with a high-level driver workload 224). As another example, the workload estimator 226 may associate certain conditions such as extreme weather with heightened driving demand, such that, as one possibility, the workload estimator 226 may associate certain weather conditions combined with a mid-level demand area (e.g., a merge situation) with a heightened workload estimation, such as a high-level driver workload 224. The driver workload 224 may include information indicating a relative level of current driver workload, such as by a value along a scale (e.g., from 1 to 5, from 0.01 to 1.00, etc.).

The configuration server 228 may be a server device configured to facilitate configuration of the scripting settings 216 through a user interface that is available outside of the vehicle 31 and regardless of driver workload 224. In an example, the configuration server 228 may be configured to provide a web-based front end user interface (e.g., one or more web pages) or data for use by a thick-client user interface, allowing for the selection of scripting settings 216, such as trigger conditions and actions to be performed by the vehicle 31 resulting from occurrence of the trigger conditions. To perform the configuration, the configuration server 228 may be configured to receive the scripting settings 216 from the vehicle 31, provide a user interface through which the scripting settings 216 may be updated, and provide the updated scripting settings back to the vehicle 31 for use by the device scripting application 214. Further details of the integration of the smart devices 202 into the vehicle 31 system are discussed in detail below with respect to FIGS. 3-8.

FIG. 3 illustrates an exemplary smart device integration system in communication with the smart device located in a home. As illustrated, the system 250 includes the smart device 202 in communication with the VCS 1 via a network connection 61 using the handheld nomadic device 53. The handheld device 53 may comprise one or more applications configured to communicate with the smart device 202 and the VCS 1. The one or more applications may be executed on hardware at the handheld device 53, the VCS 1, and/or a combination thereof.

The one or more applications at the handheld device 53 may include, but is not limited to, the smart device interface 202, the device interface 208, the smart device applications 212 configured to utilize the smart device interface 208, and/or a combination thereof. The handheld device 53 may be used to configure the smart device 202 according to user input using the smart device application 212. The handheld device 53 may receive notifications from the smart device using the device scripting application 214. The handheld device 53 may establish communication with the VCS 1 using wireless and/or wired technology. The handheld device 53 may communicate the smart device information to the VCS using the one or more applications. The VCS 1 may communicate with the smart device 202 via the handheld device 53.

The smart device 202 may be the smart smoke detector device 202 located in a house 252. The house 252 may comprise one or more smart smoke detector devices 202. The smart smoke detector device 202 may be configured with location information identifying which room it is monitoring in the house 252. For example, the smart smoke detector 202 located in the kitchen of the house 252 may be configured as the kitchen smoke detector 202. The kitchen smoke detector 202 may transmit a smoke detection alert to the VCS 1 via the handled device 53. The VCS 1 may output the alert from the kitchen smoke detector 202 to notify the vehicle occupant that smoke has been detected in the kitchen of the house 252. The output may include one or more remedial actions based on the alert.

The VCS 1 may present one or more remedial actions based on the alert notification from the smart smoke detector 202. The one or more remedial actions may include, but is not limited to, calling first responders (e.g., 911, police, fire department, etc.), calling emergency contacts (e.g., neighbors, spouse, kids, etc.), unlocking a door using a remote door lock (e.g., Schlage Z-Wave Deadbolt system) at the house 252, and/or opening a garage door via a remote garage door opening signal to allow first responders to enter the house 252.

In another example, the smart smoke detector 202 may transmit a carbon monoxide alert to the VCS 1 via the handheld device 53. In response to the carbon monoxide alert, the VCS 1 may output the alert from the smart smoke detector 202 to notify the vehicle occupant that carbon monoxide has been detected at the house 252. The output may include one or more remedial actions based on the carbon monoxide alert. The one or more remedial actions may include, but is not limited to, transmitting a message to shut off the furnace (e.g., heating and air-conditioning unit (HVAC)) at the house 252, opening a window via an automatic window opening system at the house 252, opening a garage door at the house 252, calling first responders, calling utility company, and/or a combination thereof.

Figure 4:
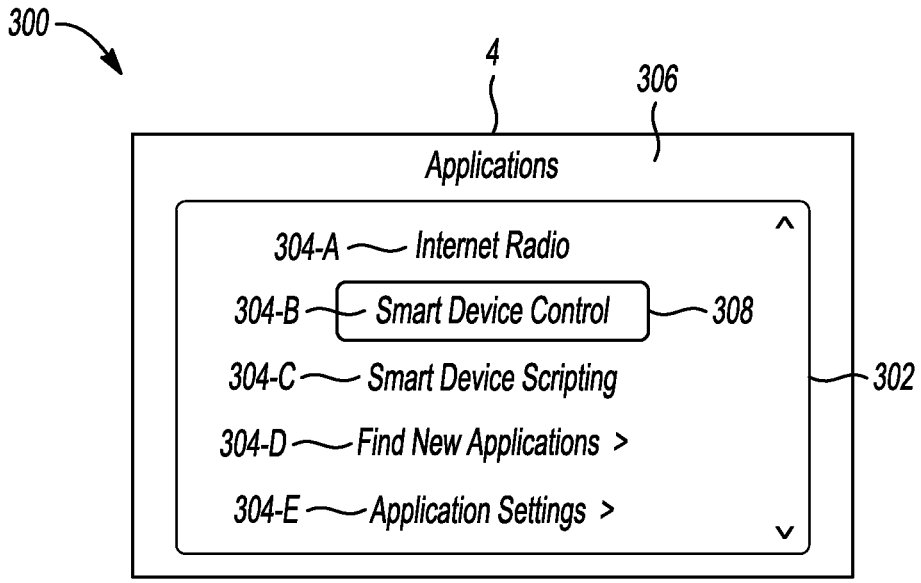
FIG. 4 illustrates an exemplary user interface of the vehicle infotainment system from which applications may be selected.

FIG. 4 illustrates an exemplary user interface 300 of the VCS 1 from which applications may be selected. The user interface 300 may be presented in the vehicle 31 via the display 4, and may include a list control 302 configured to display selectable list entries 304-A through 304-E (collectively 304) of the application that are available on the VCS 1 (or via a connected nomadic device 53). In other examples, the user interface 300 and the other user interfaces discussed herein may be displayed elsewhere, such as by way of a connected application executed by a nomadic device 53 paired with the VCS 1. The user interface 300 may also include a title label 306 to indicate to the user that the user interface 300 is for utilizing the connected applications of the nomadic device 53.

As illustrated, the selectable list 302 of the connected application includes an entry 304-A for an Internet radio application, an entry 304-B for a smart device application 212 and an entry 304-C for the device scripting application 214. The list control 302 may operate as a menu, such that a user of the user interface 300 may be able to scroll through list entries of the list control 302 (e.g., using up and down arrow buttons and a select button to invoke the selected menu item 308). In some cases, the list control 302 may be displayed on a touch screen display 4, such that the user may be able to touch the list control 302 to select and invoke a menu item. For example, when the entry 304-C for the device scripting application 214 is selected, the VCS 1 may initiate the device scripting application 214.

The list control 302 may further include additional entries. For example, the "Find New Applications" entry 304-D, when invoked, may be configured to cause the VCS 1 to query for an updated listing of the applications available to the system (e.g., on the VCS 1, via installed on a connected nomadic device 53, etc.). As another example, the "Application Settings" entry 304-E, when invoked, may be configured to cause the VCS 1 to display a user interface of settings for the application functionality generally.

Figure 5:
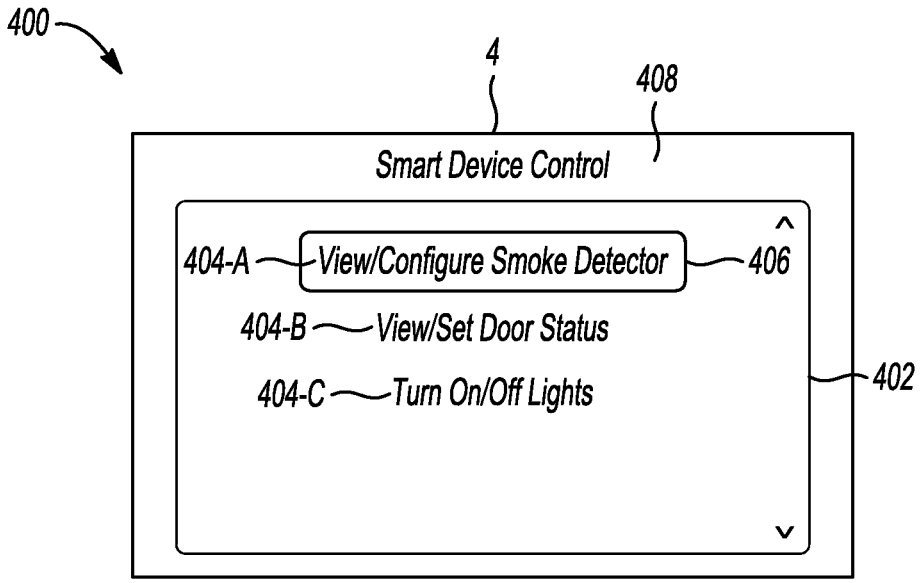
FIG. 5 illustrates an exemplary main user interface of the smart device application.

FIG. 5 illustrates an exemplary main user interface 400 of the smart device application 212. As with the user interface 300, the user interface 400 may also be presented in the vehicle 31 via the display 4. The user interface 400 may include a list control 402 configured to display a selectable list of entries, where each entry is associated with a corresponding application command 404-A through 404-C (collectively 404). Each of the commands 404 may indicate a feature available for use by the VCS 1 in communication with the smart devices 202 via the smart device interface 208. The user interface 400 may also include a title label 408 to indicate to the user that the user interface 400 is for the smart device application 212 (e.g., as invoked via selection of the entry 304-B from the user interface 300).

With respect to the commands 404 of the list control 402, as one example, the list control 402 may include a command 404-A that, when invoked, is configured to cause the VCS 1 to display a user interface including a viewing of a status for one or more smart smoke detectors, a configuration of a smoke detection emergency contact list, and/or configuration of one or more remedial action related to a received alert from the smart smoke detector 202. As another example, the list control 402 may include a command 404-B that, when invoked, is configured to cause the VCS 1 to display a user interface facilitating the viewing and setting of a door unlock/lock status. As a further example, the list control 402 may include a command 404-C that, when invoked, is configured to cause the VCS 1 to display a user interface facilitating the turning on or off of automated lights.

As with the list control 302, the list control 402 may also operate as a menu, such that a user of the user interface 400 may be able to scroll through list entries of the list control 402 (e.g., using up and down arrow buttons and a select button to invoke the selected menu item 406). Upon touch or button selection of one of the commands 404, the VCS 1 may be configured to perform the selected action.

Figure 6:
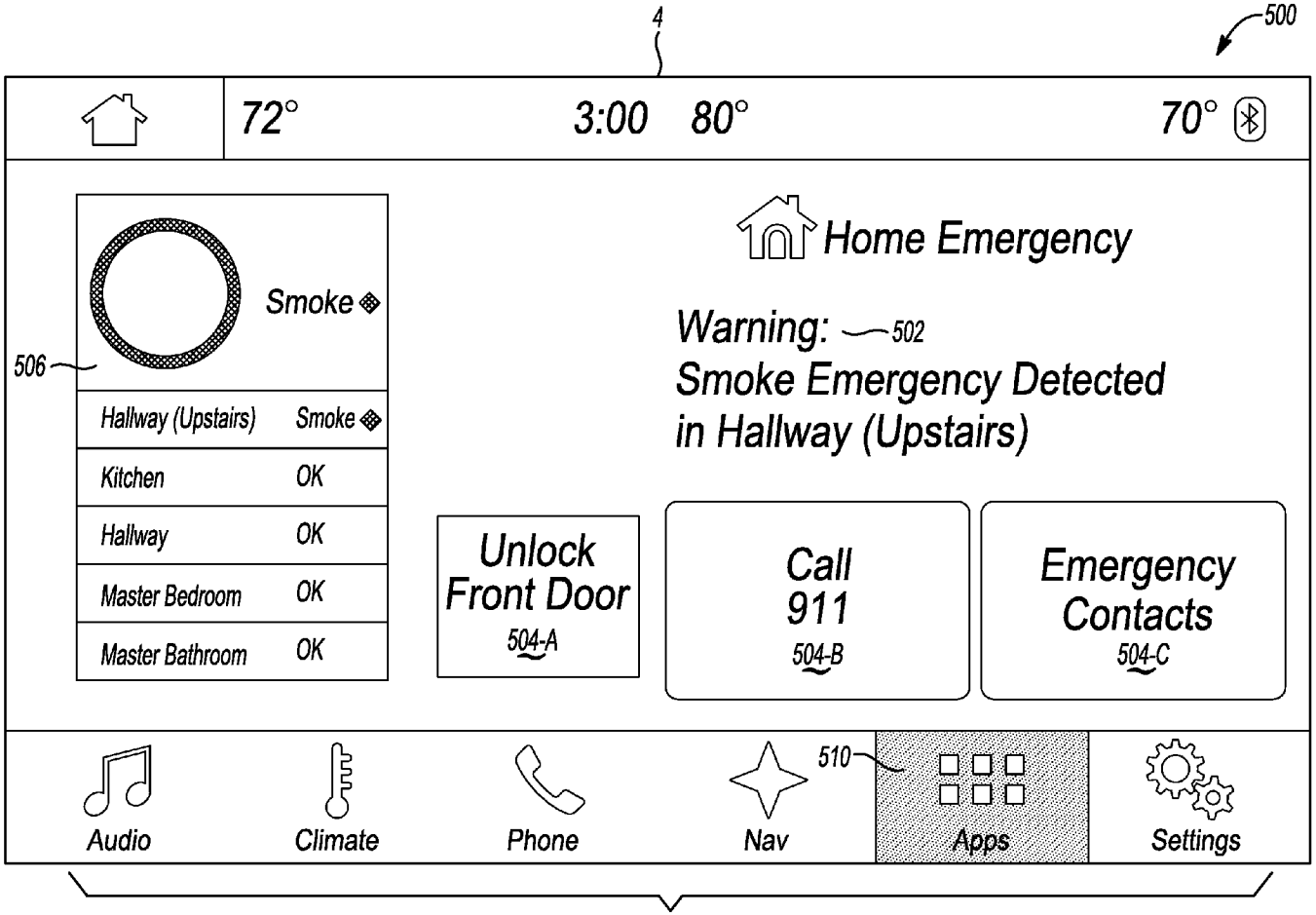
FIG. 6 illustrates an exemplary alert notification user interface of the smart device application

FIG. 6 illustrates an exemplary alert notification user interface 500 of the smart device application 212. The user interface 500 may be presented in the vehicle 31 via the display 4, and may include an alert message 502, a list of one or more remedial actions 504-A through 504-C (collectively 504), and a status list 506 of one or more smart smoke detectors 202. The user interface 500 may also include a horizontal tab list 508 at the bottom of the display 4 to enable the user to select the application feature 510 for display to monitor the status of the smart device 202.

As illustrated, the alert message 502 may provide information to the user as to which smart device is providing information. For example, if the smart smoke detector 202 located in the upstairs hallway of the house 252 detects smoke; the VCS 1 may receive the alert message from the detector 202 and output the alert message 502 at the display 4. The alert notification user interface 500 may provide the one or more remedial actions 504 based on the received information from the smart smoke detector 202. The one or more remedial actions may include, but is not limited to, unlocking the front door 504-A, calling 911 emergency 504-B (e.g., local fire department), and/or contacting emergency contacts 504-C.

For example, in response to receiving an alert from the smart smoke detector 202, the VCS 1 may enable the user to remotely unlock the front door 504A and call the fire department 504B to let them know of the smoke detection alert and that the front door is open for easy access into the house 252. The VCS 1 may receive the unlock front door 504A request at the display 4 and generate one or more message for transmission to the remote lock system via a wireless communication connection.

The status list 506 may provide visual monitoring at the display 4 for the smart smoke detector(s) 202 located at the house 252. For example, if an alert message is received from the smart smoke detector 202 located in the upstairs hallway, the status list 506 may provide a visual to determine if smoke has been detected by the other smart smoke detector(s) 202 located in the house 252. The status list 506 may be communicated to the emergency dispatcher via the 911 call 504-B.

The alert notification user interface 500 may present information based on configurations done at the VCS 1, the smart device 202, handheld device, and/or a combination thereof. The VCS 1 may configure the settings of the smart device via the smart smoke detector device application 212. For example, the VCS 1 may configure the emergency contacts for the smart smoke detector 202. In another example, the emergency contacts may be configured at the handheld device 53 and communicated to the VCS 1 once the device 53 is paired.

In another example, the VCS 1 may limit the amount of information provided in the alert notification user interface 500 based on the device scripting application 214, driver workload 224, and/or a combination thereof. For example, if the VCS 1 receives an alert message from the smart smoke detector 202, the system may determine the driver workload 224 before outputting information. In another example, if the vehicle 31 is traveling at a high rate of speed above a threshold value while the VCS 1 receives an alert message from the smart smoke detector 202, the system may limit the information presented to a driver. The limited information presented to the driver may include a warning message 502 and the Call 911 504-B remedial action at the display 4.

Figure 7:
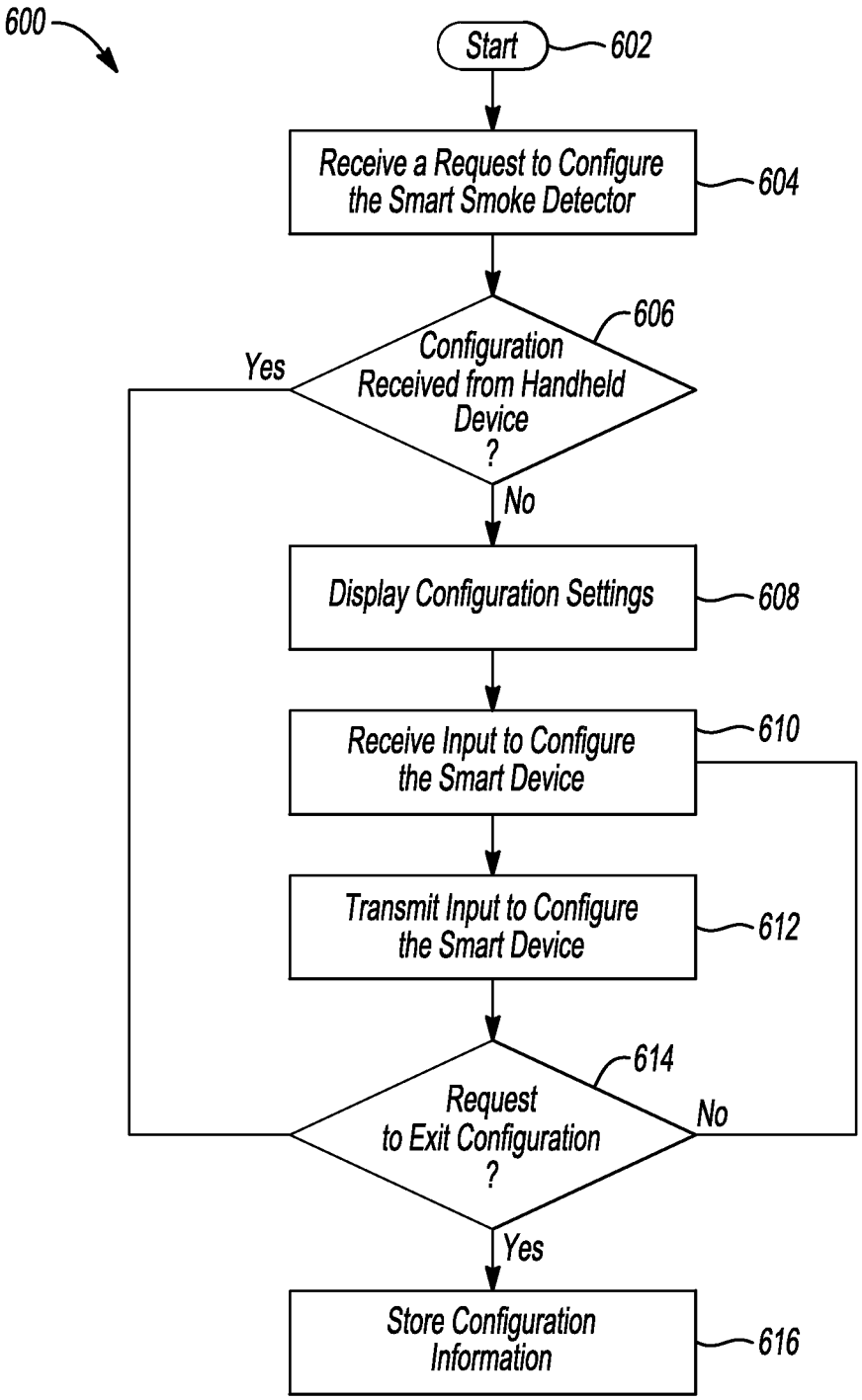
FIG. 7 illustrates an exemplary process for the configuration of the smart device by the vehicle.

FIG. 7 illustrates an exemplary process 600 for the configuration of the smart device 202 by the VCS 1. The process 600 may be implemented using software code contained within the VCS 1, the smart device 202, the handheld device 53, and/or a combination thereof. In other embodiments, the process 600 may be implemented in other vehicle controllers, or distributed among multiple controllers in communication with the VCS 1.

Referring again to FIG. 7, the vehicle 31 and its components illustrated in FIG. 1, FIG. 2, and FIG. 3 are referenced throughout the description of the process to facilitate understanding of various aspects of the present disclosure. The process 600 of configuring a smart device 202 integration with the VCS 1 may be implemented through a computer algorithm, machine executable code, or software instructions programmed into a suitable programmable logic device(s) of the vehicle, such as the vehicle control module, the smart device control module, the handheld device 53, another controller in communication with the vehicle computing system, or a combination thereof. Although the various operations shown in the flowchart diagram 600 appear to occur in a chronological sequence, at least some of the operations may occur in a different order, and some operations may be performed concurrently or not at all.

In operation 602, the smart device configuration process by the VCS 1 may be enabled by a start request received from one or more mechanisms including, but not limited to, a vehicle key, a vehicle key fob, the handheld device 53, and/or a combination thereof. The VCS 1 may initialize one or more applications for execution of the smart device configuration process. In response to the initialization, the process 600 may receive a request to configure the smart smoke detector 202 in operation 604. For example, the VCS 1 may receive a smart device configuration request via input received at the display 4. In another example, the VCS 1 may receive the smart device configuration request from a handheld device 53 in communication with the VCS.

In operation 606, the process 600 may determine if the smart device 202 configuration is completed and received from the handheld device 53. The VCS 1 may receive the smart device configuration from the handheld device 53 via a wireless communication. If the smart device configuration is not received from the handheld device 53, the VCS 1 may output configuration settings in operation 608.

The configuration settings may include assigning a name for the smart smoke detector 202. For example, the smart smoke detector 202 may be located in the kitchen of the house 252, therefore a user may assign the name to the smart smoke detector as the kitchen smoke detector. The configuration settings for the smart device 202 may also include an emergency contact list, commands associated with other smart devices (e.g., remote unlock device), and/or other remedial actions. In another example, the configuration settings may include trigger conditions that configure acceptable conditions to communicate smart device information for output at the display 4.

In operation 610, the VCS 1 may receive input from the user to configure the smart device 202 via the display 4. The VCS 1 may transmit at least a portion of the configuration settings to the smart device 202 via the handheld device 53 in operation 612. For example, the VCS 1 may transmit the assigned name to the smart smoke detector 202. In another example, the VCS 1 may transmit one or more emergency contact numbers to the smart smoke detector 202, so that the configuration information may be stored in non-volatile memory of the smart device 202.

In operation 614, the VCS 1 may output a message to enable the user to request to exit the configuration of the smart device 202. If the VCS 1 receives input to exit the configuration of the smart device 202, the configuration settings may be stored in non-volatile memory of the VCS 1, handheld device, and/or a combination thereof in operation 616.

Figure 8:
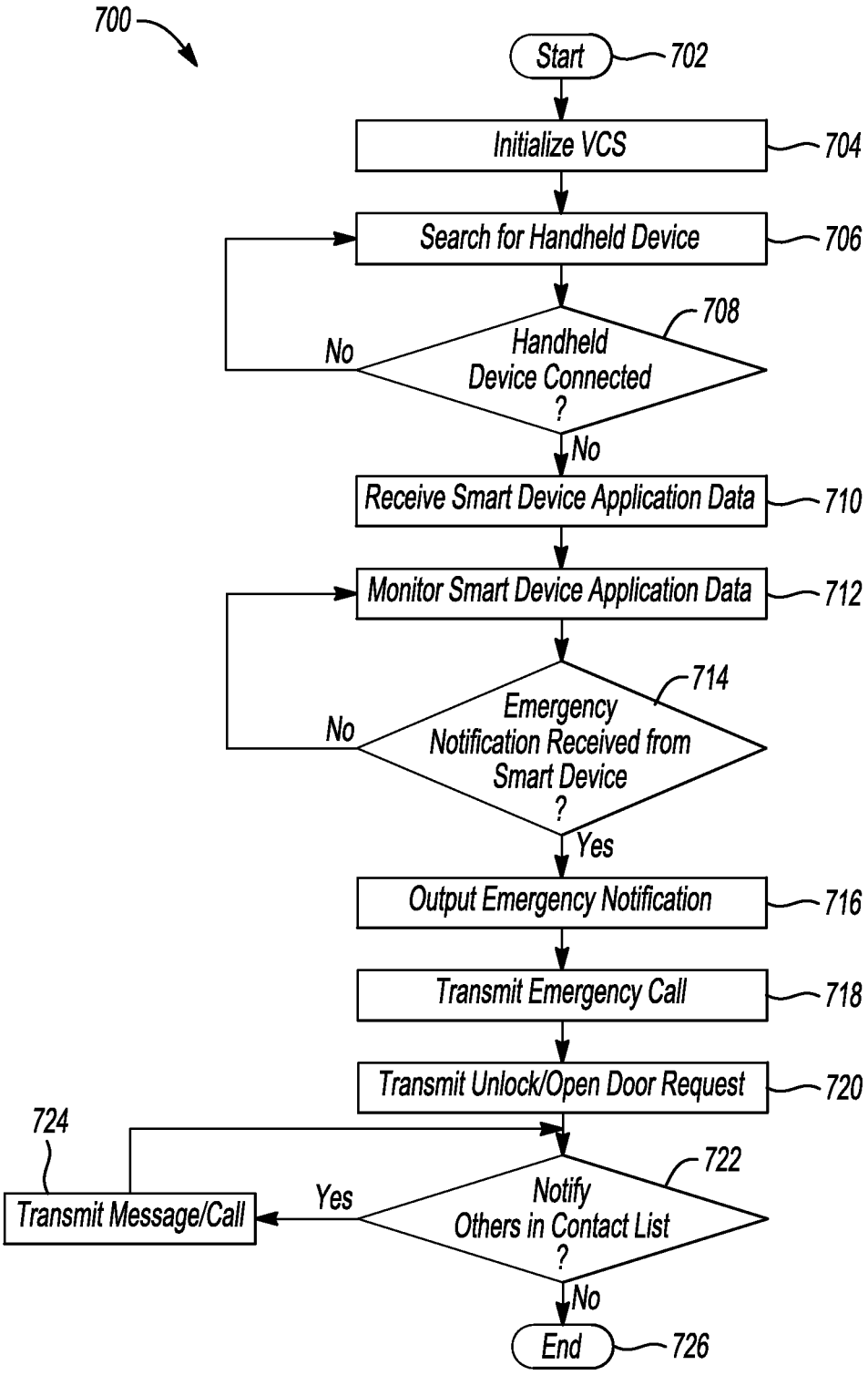
FIG. 8 illustrates an exemplary process for the execution of the smart device application by the vehicle.

FIG. 8 illustrates an exemplary process 700 for the execution of the smart device application 212 by the VCS 1. The process 700 may be implemented using software code contained within the VCS 1, the smart device 202, the handheld device 53, and/or a combination thereof. The process 700 of the VCS 1 communicating with the smart device 202 may be implemented through a computer algorithm, machine executable code, or software instructions programmed into a suitable programmable logic device(s) of the vehicle, such as the vehicle control module, the smart device control module, the handheld device 53, another controller in communication with the vehicle computing system, or a combination thereof.

In operation 702, the VCS 1 may be enabled by a start request received from one or more mechanisms including, but not limited to, a vehicle key, a vehicle key fob, the handheld device 53, and/or a combination thereof. The VCS 1 may initialize one or more applications to enable communication with the smart device in operation 704.

In operation 706, the VCS 1 may begin to search for a communication link with the handheld device 53. The communication link may include, but is not limited to, Bluetooth, Bluetooth Low Energy, WiFi, and/or any other wireless communication technology. If the handheld device 53 is detected, the VCS 1 may determine if a connection is made as indicated at 708. For example, the handheld device 53 may have to perform a pairing process before connecting to the VCS 1.

In operation 710, in response to the handheld device 53 establishing communication with the VCS 1, the system may query the handheld device 53 for smart device application data. The VCS 1 may receive at least a portion of smart device application data from the handheld device 53. For example, if the handheld device 53 is configured to communicate data with the smart smoke detector 202, the VCS 1 may receive the smart smoke detector 202 communication data via the handheld device 53.

In operation 712, the VCS 1 may monitor the smart device application data via the handheld device communication link. The VCS 1 may determine if an emergency notification is received from the smart device 202 in operation 714.

For example, in response to the smart smoke detector 202 detecting carbon monoxide to enable an emergency notification, the VCS 1 may receive the emergency notification from the smart device 202. The VCS 1 may generate one or more messages for output based on the emergency notification received from the smart device 202. The VCS 1 may output the emergency notification to notify the driver that the smart smoke detector 202 has detected a carbon monoxide alert in operation 716.

In operation 718, the VCS 1 may be configured to initiate an emergency call to one or more emergency contacts based on the carbon monoxide emergency notification message. For example, the VCS 1 may transmit an emergency call to 911 notifying first responders such that the driver may communicate the emergency notification to the 911 operator.

In operation 720, the VCS 1 may be configured to transmit an unlock and/or open door request to the remote door system at the house 252 to enable access for the first responders. For example, the VCS 1 may be configured to transmit a garage door open request to allow for fresh air to enter the house. In another example, in response to the carbon monoxide emergency notification, the VCS 1 may be configured to transmit one or more messages to disable the furnace and/or open one or more windows at the house 252.

In operation 722, the VCS 1 may determine if there is an emergency contact list based on the emergency notification. If there is an emergency contact list, the VCS 1 may be configured to generate and transmit one or more messages via text, email, etc. to notify others in the contact list of the emergency notification in operation 724. For example, in response to the carbon monoxide detection, the VCS 1 may generate and transmit a text message to all residents of the house 252 listed on the emergency contact list notifying them of a potential of a carbon monoxide leak. In another example, the VCS 1 may enable a phone call to a contact on the emergency contact list. The VCS 1 may end the process if the one or more remedial actions for the emergency notification have been completed in operation 726.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A vehicle computing system comprising:

a processor including a smart device interface configured to provide the vehicle computing system with access to a remote smoke detector device, a scripting application configured to utilize the smart device interface to execute scripting settings to manage the remote smoke detector device, and a user interface of the scripting application configured to output one or more messages from the remote smoke detector device when vehicle conditions satisfy predefined criteria, wherein the scripting settings output at the user interface display at least one of an unlock door request and open garage door request based on the one or more messages.

2. The vehicle computing system of claim 1, wherein the remote smoke detector device is at least one of a smoke detector and carbon monoxide detector exposed by network-connected smart devices over a network accessible to the smart device interface.

3. The vehicle computing system of claim 1, wherein the predefined criteria include a vehicle speed threshold acceptable for the output of the one or more messages at the user interface.

4. The vehicle computing system of claim 1, wherein the one or more messages includes at least one of a smoke alert notification and a carbon monoxide alert notification.

5. The vehicle computing system of claim 4, wherein the processor is further configured to, in response to the smoke alert notification, output to the user interface a warning message and an emergency contact number.

6. The vehicle computing system of claim 5, wherein the processor is further configured to establish a connection to the emergency contact number based on input received at the user interface.

7. A system comprising:

a user interface display; and at least one vehicle processor in communication with a remote smoke detector device, the at least one vehicle processor configured to, in response to receiving an alert message from the remote smoke detector, and vehicle speed being below a threshold, output an unlock door request or an open garage door request at the user interface display.

8. The system of claim 7, wherein the at least one vehicle processor is further configured to communicate with a transceiver to establish the communication with the remote smoke detector, the transceiver configured to connect to the remote smoke detector device via a network connection.

9. The system of claim 7, wherein the alert message is based on a detection of smoke or carbon monoxide by the remote smoke detector device.

10. The system of claim 7, wherein the at least one vehicle processor is further configured to transmit an unlock door request to a remote locking system in response to user input from the user interface display.

11. The system of claim 7, wherein the at least one vehicle processor is further configured to establish a connection to an emergency contact number based on input received at the user interface.

12. A remote smoke detection method comprising:

establishing, via a vehicle computing system (VCS), a communication link associated with a remote smoke detector device;

communicating information with the remote smoke detector device via the communication link;

receiving an emergency notification from the remote smoke detector device based on the information; and outputting an unlock door or open garage door request at the display based on the emergency notification if current vehicle operating conditions satisfy predetermined criteria.

13. The method of claim 12, further comprising configuring one or more remedial actions for the remote smoke detector device at the display.

14. The method of claim 13, wherein the one or more remedial actions are at least one of an unlock door request, and an open garage door request.

15. The method of claim 12, wherein the current vehicle operating conditions comprise a current vehicle speed and the predetermined criteria comprise a vehicle speed threshold acceptable for the output of the one or more remedial actions at the display.

* * * * *